US011661252B2

(12) United States Patent
Defois et al.

(10) Patent No.: US 11,661,252 B2
(45) Date of Patent: May 30, 2023

(54) FLIP TOP PLASTIC LID

(71) Applicant: Mead Johnson Nutrition Company, Evansville, IN (US)

(72) Inventors: Sophie Claude Marie Defois, Utrecht (NL); Grace Naguit Mercado, Singapore (SG); Christianus Petrus Johannes Van Lankveld, Huissen (NL)

(73) Assignee: Mead Johnson Nutrition Company, Evansville, IN (US)

( * ) Notice: Subject to any disclaimer, the term of this patent is extended or adjusted under 35 U.S.C. 154(b) by 0 days.

(21) Appl. No.: 16/971,655

(22) PCT Filed: Feb. 22, 2019

(86) PCT No.: PCT/GB2019/050491
§ 371 (c)(1),
(2) Date: Aug. 20, 2020

(87) PCT Pub. No.: WO2019/162685
PCT Pub. Date: Aug. 29, 2019

(65) Prior Publication Data

US 2020/0391915 A1 Dec. 17, 2020

(30) Foreign Application Priority Data

Feb. 23, 2018 (GB) ..... 1802943

(51) Int. Cl.
*B65D 43/02* (2006.01)
*B65D 43/16* (2006.01)
*B65D 51/24* (2006.01)

(52) U.S. Cl.
CPC ..... *B65D 51/246* (2013.01); *B65D 43/0212* (2013.01); *B65D 43/169* (2013.01);
(Continued)

(58) Field of Classification Search
CPC .... B65D 2517/0062; B65D 2517/0041; B65D 2517/0061; B65D 41/48; B65D 51/18;
(Continued)

(56) References Cited

U.S. PATENT DOCUMENTS 7,802,695 B2 * 9/2010 Baker ..... B65D 1/30 220/835
8,857,645 B2 * 10/2014 Perry ..... B65D 51/24 220/254.3

(Continued)

FOREIGN PATENT DOCUMENTS

CA 2250886 A1 10/1998
CN 203568125 U 4/2014

(Continued)

OTHER PUBLICATIONS

International Search Report and Written Opinion for PCT Application No. PCT/GB2019/050491 dated Jul. 31, 2019.

*Primary Examiner* — Jennifer Robertson
*Assistant Examiner* — John Martin Hoppmann
(74) *Attorney, Agent, or Firm* — Troutman Pepper Hamilton Sanders LLP; Ryan A. Schneider; Chris N. Davis

(57) ABSTRACT

A closure for a container is described where the container has an open end and a closed end, the closure engaging the open end of the container, wherein the closure comprises: a collar engaging the container; a lid connected to the collar by at least one hinge; wherein to facilitate engagement the collar extends over and surrounds the open end of the container such that an inner surface impinges on, or is immediately adjacent to, an outer surface of the open end of the container; wherein a plurality of beads extend outwardly from the inner surface of the collar to fixedly hold the collar in engagement with the container, wherein said beads are
(Continued)

located substantially uniformly relative to each other and occupy less than 50% of the inner surface of the collar.

9 Claims, 2 Drawing Sheets

(52) U.S. Cl.
CPC ..... *B65D 2251/1025* (2013.01); *B65D 2543/0074* (2013.01); *B65D 2543/00092* (2013.01); *B65D 2543/00296* (2013.01); *B65D 2543/00435* (2013.01); *B65D 2543/00527* (2013.01); *B65D 2543/00537* (2013.01)

(58) Field of Classification Search
CPC .... B65D 2251/0015; B65D 2251/0093; B65D 2543/00592; B65D 2543/00685; B65D 2543/00092; B65D 2543/00805; B65D 2543/00648; B65D 2543/00435; B65D 43/169; B65D 2251/0021; B65D 2251/0081
USPC .... 220/260, 270, 269, 266, 780, 254.3, 784, 220/315, 309.2, 301, 669, 309.1, 254.7, 220/300, 236, 254.1, 790; 413/25, 12, 413/14, 16
See application file for complete search history.

(56) References Cited

U.S. PATENT DOCUMENTS

| | | | | |
|---|---|---|---|---|
| 2001/0032827 | A1 | 10/2001 | Montgomery et al. | |
| 2005/0029266 | A1 | 2/2005 | Ziegenhorn et al. | |
| 2005/0035122 | A1 | 2/2005 | Ekkert | |
| 2006/0163265 | A1* | 7/2006 | De Candido | B29C 45/4407 220/784 |
| 2007/0114236 | A1* | 5/2007 | Shiffer | B65D 43/0212 220/782 |
| 2009/0223967 | A1* | 9/2009 | Mengeu | B65D 50/046 220/793 |
| 2013/0134057 | A1* | 5/2013 | Horton | B65D 51/246 206/229 |
| 2016/0000270 | A1 | 1/2016 | Wiggins et al. | |
| 2016/0297575 | A1 | 10/2016 | McBroom et al. | |

FOREIGN PATENT DOCUMENTS

| | | | | |
|---|---|---|---|---|
| EP | 0370982 | A1 | 5/1990 | |
| EP | 0370982 | A1 * | 5/1990 | B65D 15/22 |
| EP | 0870693 | A2 * | 10/1998 | B65D 41/34 |
| EP | 1512637 | A1 | 3/2005 | |
| EP | 1852364 | A1 | 11/2007 | |
| EP | 3070022 | A2 | 9/2016 | |
| GB | 1556662 | | 11/1979 | |
| GB | 2272209 | A | 5/1994 | |
| KR | 101791410 | B1 | 11/2017 | |
| WO | 1997043188 | A1 | 11/1997 | |
| WO | WO-0222459 | A1 * | 3/2002 | B65D 43/0231 |
| WO | 2011081677 | A1 | 7/2011 | |
| WO | 2016022744 | A1 | 2/2016 | |
| WO | WO-2016022744 | A1 * | 2/2016 | B65D 41/465 |
| WO | 2016126194 | A1 | 8/2016 | |
| WO | WO-2016195616 | A1 * | 12/2016 | B65D 51/246 |
| WO | 2017096191 | A1 | 6/2017 | |

* cited by examiner

FLIP TOP PLASTIC LID

CROSS-REFERENCE TO RELATED APPLICATIONS

This application is a national stage entry of PCT Application No. PCT/GB2019/050491, filed on 22 Feb. 2019, which claims the benefit of GB Application No. 1802943.9, filed on 23 Feb. 2018, the disclosures of each of which are herein incorporated by reference in their entirety.

FIELD OF THE INVENTION

The present invention relates to a plastics closure for a container holding a granular powder or powder and particularly, but not exclusively, to a plastics flip top closure for a container holding granular powder or powder in the form of infant formula.

BACKGROUND

There are many products in granular powder or powdered form that are currently stored and sold in containers. These products include infant formula, flour, coffee, sugar and nutritional supplements, such as protein or dietary supplements. Many of these products are stored, shipped and ultimately dispensed from the same container, the container should be robust enough to withstand the conditions to which it is likely to be exposed. Additionally, the container should be user friendly for the ultimate consumer.

Containers formed of plastic and/or metal are often used to store and sell various granular products, particularly in the industrial, food, and pharmaceutical sectors. Some containers may include a lid or closure such that the container can be repeatedly opened and closed. One problem often associated with such containers is leakage of the product from the container. Such leakage typically occurs in the area around the closure. Moreover, if a lid or closure does not provide an adequate seal, contaminants can more readily be introduced into the product stored in the container, resulting in spoilage or other deleterious effects. As such, while some containers include resealable lids which a user can open and close to access product contained within the container, many of these lids do not provide a sufficiently secure seal.

The application of the closure to the container often occurs on semi-automated production lines. It would be preferable in some circumstances for a fully automated production line to apply the closure to the container, however, one drawback with a fully automated production line is the reduction of available capping force which would render many prior art closures unsuitable therefor.

Some containers include a measuring device or scoop which allows the consumer to remove the product from the container in a measured amount. There are two conventional methods for locating the scoop within the product, the first is for the scoop to be located loosely within powder. Consumers have increasingly found this method to be frustrating as the process of transportation of the product often causes the scoop to submerge into the powder requiring the consumer to use their fingers to delve into the powder and retrieve it which, despite the inconvenience, could introduce unwanted hygiene factors to the powder. The alternative method relies on the provision of a docking means for the scoop located on an interior surface of the closure. Whilst such docking means are designed to avoid the drawback of the scoop being loose with the powder, with some docking means the scoop may be loosened during transportation and the scoop will fall into the powder. A further drawback is that is can be challenging for a consumer to easily return the scoop to the docking means after use, particularly when applying pressure to the interior surface of the closure and potentially unbalancing the container with the risk that the container topples over and there is a spillage of powder.

Accordingly it is an object of the present invention to remove, reduce or ameliorate the above-mentioned drawbacks as well as other drawbacks with the prior art.

SUMMARY OF INVENTION

According to a first aspect of the present invention there is provided therefore a closure for a container wherein the container has an open end and a closed end, the closure being configured to engage the open end of the container, wherein the closure comprises: a collar configured to engage the container; a lid connected to the collar by at least one hinge; wherein to facilitate engagement the collar is configured to extend over and surround the open end of the container such that an inner surface impinges on, or is immediately adjacent to, an outer surface of the open end of the container; characterised in that a plurality of beads extend outwardly from the inner surface of the collar to fixedly hold the collar in engagement with the container, wherein said beads are located substantially uniformly relative to each other and occupy less than 50% of the inner surface of the collar.

Preferably the plurality of beads are located in the same plane or an adjacent horizontal plane. Preferably the open end of the container is cylindrical or substantially cylindrical and the inner surface is correspondingly cylindrical or substantially cylindrical, and wherein the beads of the container are located in the same plane or in an adjacent radial plane relative to each other.

In a preferred arrangement between 6-8 beads are provided. The beads may occupy between 10-45% of the inner surface of the collar, and preferably occupy between 15-30% of the inner surface of the collar, and most preferably occupy 20%+/−3% of the inner surface of the collar.

Preferably the beads are located in two adjacent planes, and wherein the beads in each plane are located uniformly to each other and are offset with the location of the beads in the adjacent plane.

The closure of the present invention is preferably forced, in use, into engagement with the open end of the container by application of force commonly referred to as capping force. The bead arrangement of the present invention is preferably configured to permit a capping force of less than 70 kg capping force to be required, and even more preferably a force of between approximately 60-65 kg capping force to be required.

Prior art closures are typically provided with a continuous or contiguous bead or a threaded bead, in contrast therewith the beads provided in the present invention may be advantageous as they reduce the amount of capping force required to fixedly engage the closure with the container.

The beads may be of the same shape. Alternatively, the beads may comprise any suitable shape independent of the other beads. Preferably the beads are provided in one of two shapes to define primary beads and secondary beads, and wherein the beads in the same plane are of the same shape.

In a preferred embodiment where beads are located in two adjacent planes the plane which, in use, would first come into contact with an open end of the container is provided with primary beads and beads provided on the adjacent plane would be secondary beads. Preferably both the primary beads and secondary beads have a general shape defined by a lowermost part that is shallow and extends away from the inner surface of the collar in at least one of a curved, sloped, linearly or substantially linearly or a combination thereof before arriving at a lip, wherein said lowermost part is defined as being the part that would first contact, in use, an open end of the container. Each of said lips are preferably in the same or substantially the same radial plane. The lips may extend from the inner wall perpendicularly or substantially perpendicular.

The primary beads and the secondary beads may have different widths and depths.

The container is preferably provided with a crimp or the like at the uppermost edge thereof such that it would be the crimp that, in use, would first contact the beads. The mechanism of fixedly engaging the closure with the container initially requires the primary beads to come into contact with the uppermost edge of the open end of the container as the closure is forced theretowards. As the closure is forced further toward the container the secondary beads contact the edge of the of the open end of the container. The lips of the primary beads and secondary beads are in the same radial plane to collectively engage the crimp, thus fixedly engaging the closure to the container.

A principal advantage of providing primary beads and secondary beads is that the moment in time at which the frictional force between said beads and the crimp reaches its maximum is spread out, thus reducing the required amount of capping force to fixedly engage the closure to the container.

Preferably a plurality of vertical or substantially vertical ribs are provided extending from the inner surface of the collar. The collar may be provided with a rim at the uppermost part thereof which is spaced apart from the inner surface of the collar, and in this arrangement said ribs may support the rim by contacting or being formed with the collar. Most preferable the collar is integrally formed by injection moulding or the like. The ribs may also be sized to provide an abutment means to limit the travel of the container into the collar once the crimp has passed the lips of the beads, most preferably the ribs limit such travel to a distance substantially equal to or marginally greater than the height of the crimp.

For the avoidance of doubt, positional terms such as "upper", "lower", "side", "top", "bottom", "vertical", "horizontal," etc. refer to the closure and container when in the orientation shown in the drawings. It is to be acknowledged that the skilled person will recognize that positional closures and containers can assume different orientations when in use.

In a preferred embodiment the lid is provided with a double wall that is sized such that when the closure is in a closed orientation an outer wall and an inner wall of the lid surround the rim of the collar. This arrangement may be suitable for better preventing the ingress of moisture into the interior of the container when the closure is in a closed orientation.

The container of the present invention is preferably provided with a scoop comprising a measuring container connected to an elongate handle. Such a scoop facilitates a user in retrieving a measured amount of granular powder or powder therefrom. The scoop may comprise a tab that extends from the measuring container remote from the handle. Preferably a docking means is provided for the scoop, said docking means may be provided on an inner wall of the collar such that in a docked orientation the scoop is suspended across the collar by the docking means supporting or engaging the tab of the scoop and the handle. Preferably the docking means is provided by two shaped receiving members extending from the inner wall of the collar to face each other. The shaped receiving members preferably define a channel, wherein said channel is sized to accommodate at least a portion of the tab and at least a portion of the handle therein to support same. Most preferably the shaped receiving members are V-shaped.

One or more retaining ribs may be provided on an inner surface of the lid wherein said retaining rib(s) is sized to extend from the lid toward the scoop when the scoop is retained in the docking means when the closure is in a closed orientation. The retaining rib(s) may be triangular in shape or may be V-shaped defined by a pair of triangular ribs. In one preferred arrangement retaining rib(s) are provided facing or adjacent to one of the docking means when the closure is in a closed orientation. Alternatively in another preferred arrangement retaining rib(s) are provided facing or adjacent to both of the docking means when the closure is in a closed orientation.

The granular powder or power is preferably infant formula.

According to a second aspect of the present invention there is provided therefore a closure for a container wherein the container has an open end and a closed end, the closure being configured to engage the open end of the container, wherein the closure comprises: a collar configured to engage the container; a lid connected to the collar by at least one hinge; wherein to facilitate engagement the collar is configured to extend over and surround the open end of the container such that an inner surface impinges on, or is immediately adjacent to, an outer surface of the open end of the container; characterised in that a plurality of beads extend outwardly from the inner surface of the collar to fixedly hold the collar in engagement with the container; and wherein a docking means is provided on an inner wall of the collar suitable for releasably suspending a scoop comprising a measuring container connected to an elongate handle across an open part of the collar, wherein the scoop comprises a tab that extends from the measuring container remote form the handle.

Preferably the docking means is provided by two shaped receiving members extending from the inner wall of the collar to face each other. The shaped receiving members preferably define a channel, wherein said channel is sized to accommodate at least a portion of the lip and at least a portion of the handle therein to support same. Most preferably the shaped receiving members are V-shaped.

One or more retaining ribs may be provided on an inner surface of the lid wherein said retaining rib(s) is sized to extend from the lid toward the scoop when the scoop is retained in the docking means when the closure is in a closed orientation. The retaining rib(s) may be triangular in shape or may be V-shaped defined by a pair of triangular ribs. In one preferred arrangement retaining rib(s) are provided facing or adjacent to one of the docking means when the closure is in a closed orientation. Alternatively in another preferred arrangement retaining rib(s) are provided facing or adjacent to both of the docking means when the closure is in a closed orientation.

The granular powder or power is preferably infant formula.

BRIEF DESCRIPTION OF THE DRAWINGS

Embodiments of the invention will now be described, by way of example only, with reference to the following drawings in which.

DESCRIPTION OF AN EMBODIMENT

Figure 1:
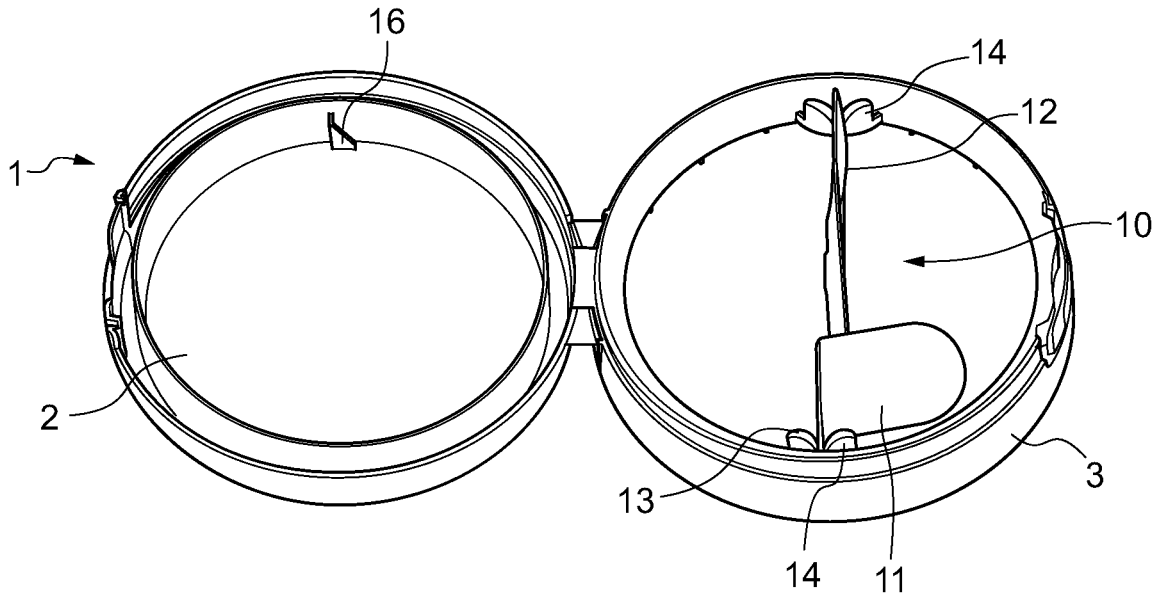
FIG. 1 illustrates a perspective view of a closure according to the present invention in an open configuration.

FIG. 1 shows a closure 1 in an open configuration. The closure 1 comprises a collar 2 and a lid 3 which are connected to each other by hinge 4. The collar 2 is sized to fit over an open end of a correspondingly shaped container (not shown) such that the inner surface 5 of the collar impinges or is immediately adjacent to an outer surface of the container.

Figure 2:
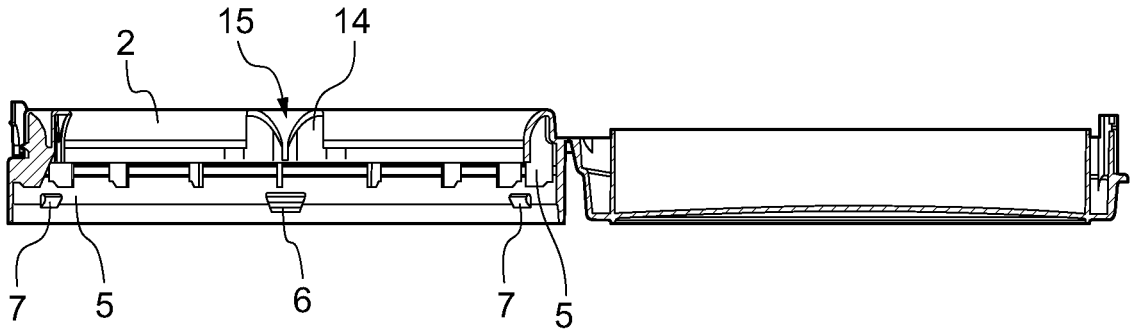
FIG. 2 illustrates a cross-sectional view of a closure according to the present invention.
Figure 3:
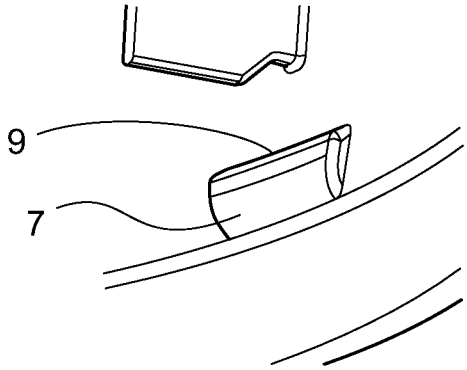
FIG. 3 illustrates a secondary bead.
Figure 4:
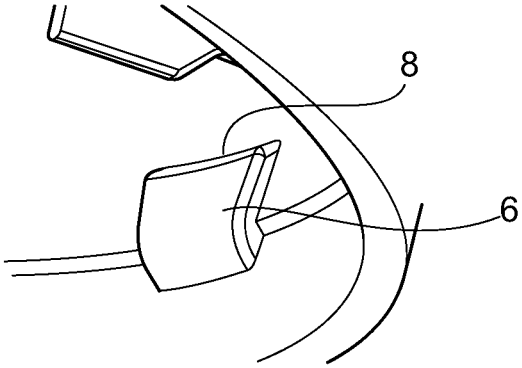
FIG. 4 illustrates a primary bead.

As can be seen in FIGS. 2-4, the inner surface 5 of the collar 2 is provided with a plurality of beads 6,7. The beads 6,7 extend outwardly from the inner surface 5 of the collar 2 to fixedly hold the lid 3 in engagement with the container. The beads 6,7 are located substantially uniformly relative to each other and occupy less than 50% of the inner surface of the collar. The beads are illustrated as provided in two formats, primary beads 6 and secondary beads 7. In the illustrated embodiment of the present invention there are three primary beads 6 located in the same radial plane substantially uniformly relative to each other and in an adjacent radial plane there are provided three secondary beads 7 located in the same radial plane substantially uniformly relative to each other.

For the avoidance of doubt, positional terms such as "upper", "lower", "side", "top", "bottom", "vertical", "horizontal," etc. refer to the closure 1 and container when in the orientation shown in the drawings. It is to be acknowledged that the skilled person will recognize that positional closures 1 and containers can assume different orientations when in use.

In use the closure 1 would be forced into engagement with the open end of the container by application of force, commonly referred to as capping force. The bead 6 arrangement of the present invention is preferably configured to permit a capping force of less than 70 kg capping force to be required, and even more preferably a force of between approximately 60-65 kg capping force to be required.

The mechanism of fixedly engaging the closure 1 with the container initially requires the three primary beads 6 to come into contact with an edge of the open end of the container. As the closure is forced further toward the container the three secondary beads 7 contact the edge of the of the open end of the container. The beads 6,7 are each provided with a lip 8,9 located in the same radial plane to better engage the open end of the container. The container is preferably provided with a crimp for improved engagement with the lips 8,9.

Figure 5:
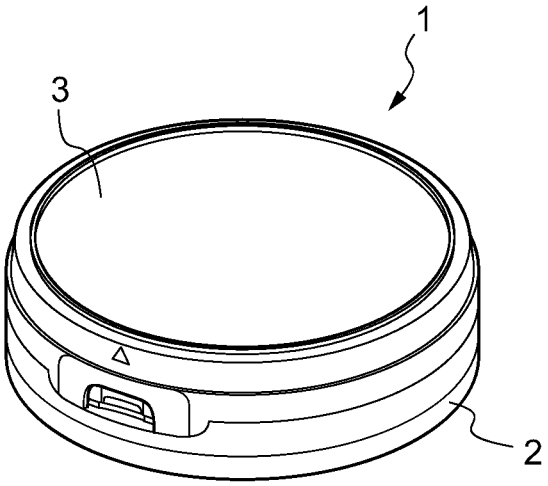
FIG. 5 illustrates a perspective view of a closure according to the present invention in a closed configuration.

The collar 2 is further provided with a scoop 10 releasably retained within a docking means 14. The scoop 10 comprises a measuring container 11 with an elongate handle 12 extending from one side and a tab 13 extending from the opposite side. The docking means 14 comprises two V-shaped protrusions 15 which are sized to respectively receive the handle 12 and tab 13 therein to suspend the scoop 10 across the collar 2. A retaining rib 16, preferably partially triangular in shape, is provided on an inner surface of the lid 3. The retaining rib 16 is sized to restrict the movement of the handle 12 when the closure 1 is in a closed configuration as shown in FIG. 5.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A closure for a container wherein the container has an open end and a closed end with a crimp at an uppermost edge of the open end, the closure being configured to engage the open end of the container, wherein the closure comprises:

a collar configured to engage the container;

a lid connected to the collar by at least one hinge;

wherein to facilitate engagement the collar is configured to extend over and surround the open end of the container such that an inner surface impinges on, or is immediately adjacent to, an outer surface of the open end of the container, wherein a plurality of beads extend outwardly from the inner surface of the collar to fixedly hold the collar in engagement with the container, wherein the plurality of beads are located substantially uniformly relative to each other and occupy between 10% and 50% of the inner surface of the collar, wherein the plurality of beads are located in the same plane or an adjacent horizontal plane, wherein the beads are provided in one of two shapes to define primary beads and secondary beads, wherein the beads in the same plane are of the same shape, wherein primary beads and secondary beads have a general shape defined by a lowermost part that is shallow and extends away from the inner surface of the collar in at least one of a curved, sloped, linearly or substantially linearly or a combination thereof before arriving at a lip, and wherein each of said lips are in the same or substantially the same radial plane and said lips extend from the inner surface substantially perpendicular, and wherein the lips of the primary beads and secondary beads are in the same radial plane to collectively engage the crimp.

2. The closure according to claim 1, wherein between 6-8 beads are provided.

3. The closure according to claim 1, wherein the beads occupy between 10-45% of the inner surface of the collar.

4. The closure according to claim 1, wherein the beads are located in two adjacent planes, and wherein the beads in each plane are located uniformly to each other and are offset with the location of the beads in the adjacent plane.

5. The closure according to claim 1, further comprising a plurality of vertical or substantially vertical ribs extending from the inner surface of the collar, and wherein the collar is provided with a rim at the uppermost part thereof which is spaced apart from the inner surface of the collar, and wherein said ribs support the rim.

6. The closure according to claim 5, wherein said ribs are sized to provide an abutment means to limit the travel of the container into the collar.

7. The closure according to claim 5, wherein the lid is provided with a double wall that is sized such that when the closure is in a closed orientation an outer wall and an inner wall of the lid surround the rim of the collar.

8. The closure according to claim 1, wherein the beads occupy between 15-30% of the inner surface of the collar.

9. The closure according to claim 1, wherein the beads occupy 20%+/−3% of the inner surface of the collar.

* * * * *